United States Patent [19]

Nakamura

[11] Patent Number: 5,030,989

[45] Date of Patent: Jul. 9, 1991

[54] DISTORTION CHECKING DEVICE IN AN ELECTROPHOTOGRAPHIC COPYING APPARATUS

[75] Inventor: Toru Nakamura, Neyagawa, Japan

[73] Assignee: Mita Industrial Co., Ltd., Osaka, Japan

[21] Appl. No.: 462,768

[22] Filed: Jan. 10, 1990

[30] Foreign Application Priority Data

Jan. 14, 1989 [JP] Japan ..... 1-7156

[51] Int. Cl.[5] ..... G03G 21/00

[52] U.S. Cl. ..... 355/203; 355/204; 355/208; 355/218

[58] Field of Search ..... 355/203, 204, 218, 317, 355/309, 206, 208

[56] References Cited

U.S. PATENT DOCUMENTS 4,697,916 10/1987 Komiya et al. ..... 355/218
4,708,464 11/1987 Otsuki et al. ..... 355/218 X
4,743,944 5/1988 Tomosada et al. ..... 355/218
4,831,420 5/1989 Walsh et al. ..... 355/203
4,851,878 7/1989 Sumida ..... 355/204

*Primary Examiner*—A. T. Grimley
*Assistant Examiner*—Thu A. Dang
*Attorney, Agent, or Firm*—Antonelli, Terry, Stout & Kraus

[57] ABSTRACT

An electrophotographic copying apparatus including by a blank lamp lighting control for lighting only predetermined ones of emitters forming a blank lamp during the operation of image forming apparatus in a check mode. If copying is carried out in the check mode, some stripes are drawn on copied images in parallel with the direction of movement of a photoreceptor by lighting of a predetermined number of the emitters. Further, the aforementioned blank lamp is constructed to light all the emitters simultaneously for a short time, so that stripes are drawn on the copied images perpendicular to the direction of movement of the photoreceptor. Depending on the parallelism of the stripes with the sides of a copying paper, it can be determined whether the distortion in the copied images is caused by the optical system or by the copying paper conveying mechanism.

8 Claims, 6 Drawing Sheets

$a \neq b$ $a = b$

DISTORTION CHECKING DEVICE IN AN ELECTROPHOTOGRAPHIC COPYING APPARATUS

BACKGROUND OF THE INVENTION

The present invention relates to an electrophotographic copying apparatus and more particularly to an electrophotographic copying apparatus capable of more easily detecting the cause of distortion in copied images.

In conventional electrophotographic copying apparatus, even if a document is properly set in place, distortion is sometimes caused in the copied images. By way of example, when the document shown in FIG. 8A is copied, the copied image is sometimes distorted as shown in FIG. 8B.

There are two causes for such distortion in the copied images. One cause is that the optical system is not properly adjusted and is distorted. More specifically, a mirror forming the optical system is deviated from its correct position. The optical system in an electrophotographic copying apparatus illuminates the document and exposes a photoreceptor by the light thus reflected to form electrostatic latent images. Therefore, if the optical system is distorted, normal electrostatic latent images cannot be formed, and thereby the copied images are caused to be distorted.

Another cause is that the copying paper is obliquely conveyed. When the copying paper, which is to be conveyed in parallel with a predetermined direction, is obliquely conveyed, the copied images on the copying paper are naturally distorted.

Conventional electrophotographic copying apparatus does not include a special mechanism for detecting whether the image distortion described above is caused by distortion of the optical system or by oblique transfer of the paper. For this reason, when servicemen adjust an electrophotographic copying apparatus in which the images are distorted to make the image normal, they need check both the optical system and the copying paper conveying mechanism.

If the electrophotographic copying apparatus has a reduction magnification function, the document is reduction-copied, and thereby the cause of distortion can be determined. For example, as shown in FIG. 9A, if the side edge of the reduction-copied document images is not parallel with the side of the copying paper so that $a \neq b$, it can be determined that the distortion is caused by the copying paper being conveyed obliquely. As shown in FIG. 9B, if the side edge of the reduction-copied document images is parallel with the side of the copying paper so that $a=b$, it can be determined that the distortion is caused by the optical system.

As mentioned above, servicemen can check both the optical system and the copying paper conveying mechanism, determine the cause of the distortion in the copied images, and adjust the electrophotographic copying apparatus to the normal condition.

However, if the electrophotographic copying apparatus has no reduction magnification function, both the optical system and the copying paper conveying mechanism should be checked actually, and it takes a lot of time to adjust the electrophotographic copying apparatus to the normal condition.

Further, if the electrophotographic copying apparatus has the reduction function, the cause of the distortion in copied images is determined using the reduction function thereof as mentioned above. However, to determine the cause accurately using the reduction function, the document is required to be rectangularly placed on a platen cover accurately. Accordingly, this work is laborious and takes a lot of time. If the reduction-magnification is set too small, the side edge of the document images is detached from that of the copying paper, and therefore it is difficult to decide whether they are mutually parallel. If the reduction-magnification is set too large (if it is nearly 1), the side edge of the document images is attached to that of the copying paper and it is also difficult to decide whether they are mutually parallel. In sum, the reduction-magnification is required to be adjusted to the most appropriate one. But this work takes a lot of time.

SUMMARY OF THE INVENTION

It is an object of the present invention to provide an electrophotographic copying apparatus capable of determining the cause of distortion in copied images more easily in any case.

The present invention provides an electrophotographic copying apparatus characterized by blank lamp lighting control means, for lighting only predetermined ones of emitters forming a blank lamp during the operation of the image forming means when the copying is started in a check mode.

If the copying is carried out in the check mode using the aforementioned electrophotographic copying apparatus, stripes are drawn on the copied image in parallel with the direction of movement of a photoreceptor by the light-emitting of the predetermined number of emitters. Depending on the parallelism of the stripes thus drawn with the side of a copying paper, it can be determined whether the distortion in the copied images is caused the optical system or by the copying paper conveying system.

If the aforementioned blank lamp is controlled to light a series of emitters simultaneously for a short time, stripes are drawn on the copied image perpendicular to the direction of movement of the photoreceptor.

Depending on the parallelism of the stripes thus drawn with the side of the copying paper, it can be determined whether the distortion in the copied images is caused by the optical system or by the copying paper conveying mechanism.

The aforementioned and other features of the present invention will be apparent in the following description with reference to the accompanying drawings.

DETAILED DESCRIPTION OF A PREFERRED EMBODIMENT

Figure 10:
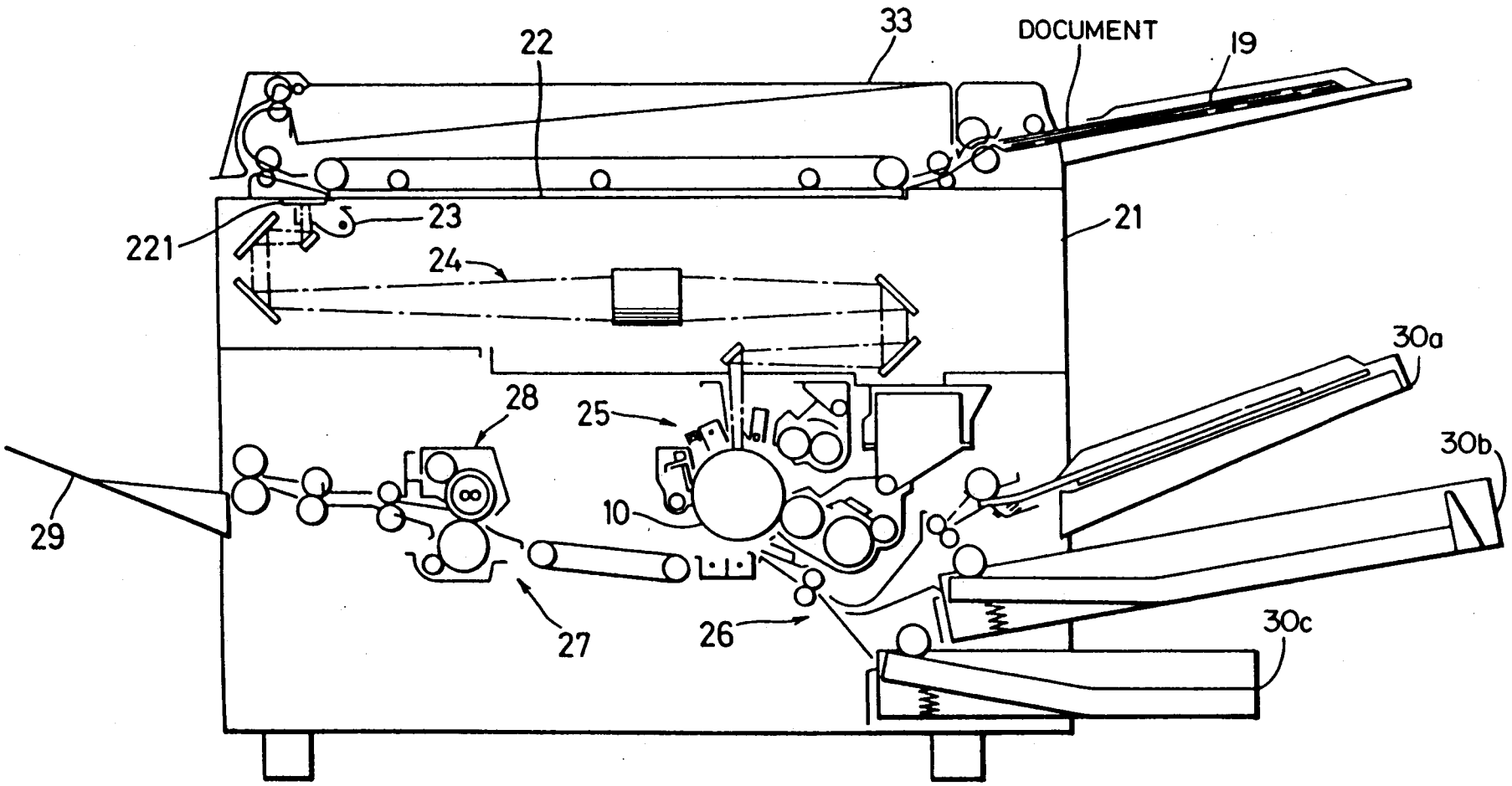
FIG. 10 depicts the inner structure of an electrophotographic copying apparatus.

FIG. 10 is a sectional view showing schematically a structure of an electrophotographic copying apparatus related to one embodiment of the present invention.

A transparent plate 22 is provided on the top surface of an electrophotographic copying apparatus body 21. A device 33 for automatically circulating a document is provided thereon to transfer the documents from a stack 19 onto the transparent platen 22 one by one.

The electrophotographic copying apparatus body 21 comprises a light 23 for illuminating the document set on the transparent plate 22, an optical system 24 for guiding the light reflected from the document, an image forming section 25 for forming electrostatic latent images of the document by the electrophotographic method and developing the images thus formed into toner images, a copying paper feeding mechanism 26 for feeding copying papers from a cassette such as cassettes 30*a*, 30*b*, 30*c* and conveying the copying papers to the image forming section 25, and a copying paper conveying mechanism 27 for conveying copying papers from the image forming section 25 to a device 28 for fixing the toner images copied on the copying paper. Further, a discharge tray 29 for stocking the copying papers is provided downstream of the fixing device 28.

Figure 2:
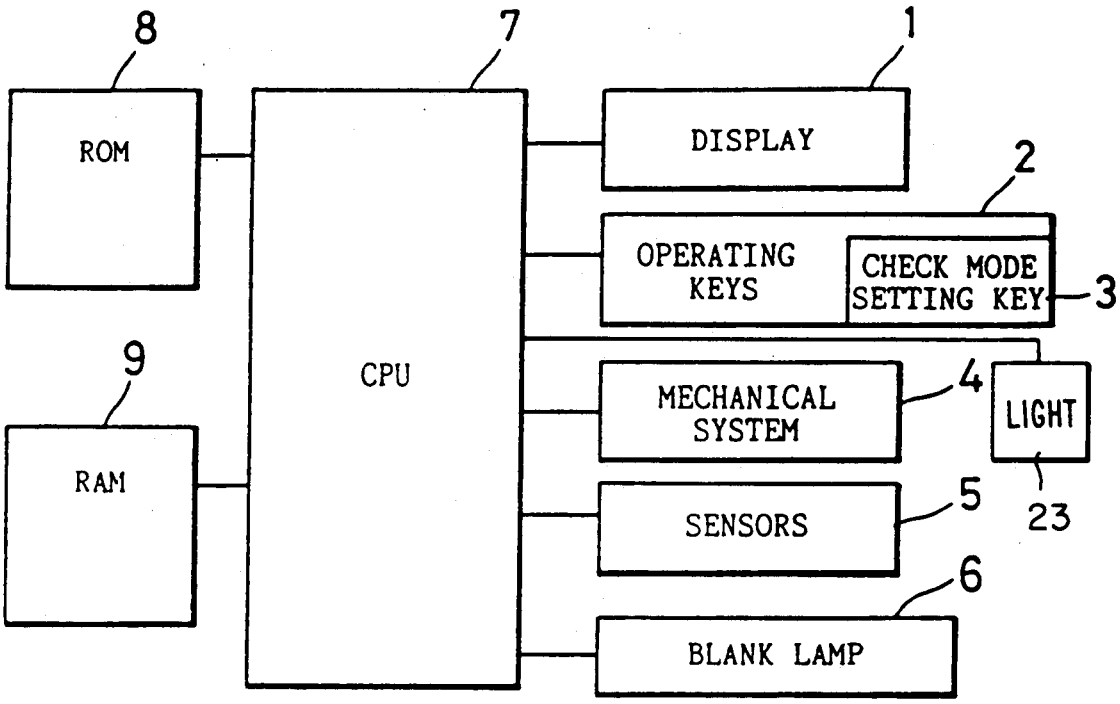
FIG. 2 is a block diagram showing the structure of an electrophotographic copying apparatus related to one embodiment of the present invention.

FIG. 2 is a block diagram showing the electrical structure of the electrophotographic copying apparatus. The electrophotographic copying apparatus includes a display 1 for displaying various data, such as operating procedure, setting mode and the like, and a variety of operating keys 2. The operating keys 2 include a check mode setting key 3 for setting the check mode to check the distortion in copied images.

The aforementioned electrophotographic copying apparatus also includes a mechanical system 4 consisting of various elements such as a motor for scanning the illuminating device 23 along the document, a motor for rotating the photoreceptor drum 10 contained in the image forming section 25, a motor for driving the copying paper feeding mechanism 26 and the copying paper conveying mechanism 27, a solenoid, a heater and the like. Further, the electrophotographic copying apparatus includes a variety of sensors 5, disposed in the mechanical system 4, and a blank lamp 6 for removing electrostatic charges unnecessary for the photoreceptor drum 10.

The aforementioned display 1, operating keys 2, mechanical system 4, sensor 5 and blank lamp 6 are respectively connected to a CPU 7 and are controlled on the basis of the operation of the CPU 7. The CPU 7 connects to a ROM 8 wherein the operating program thereof is stored and a RAM 9 for temporarily storing data necessary for the control.

Figure 3:
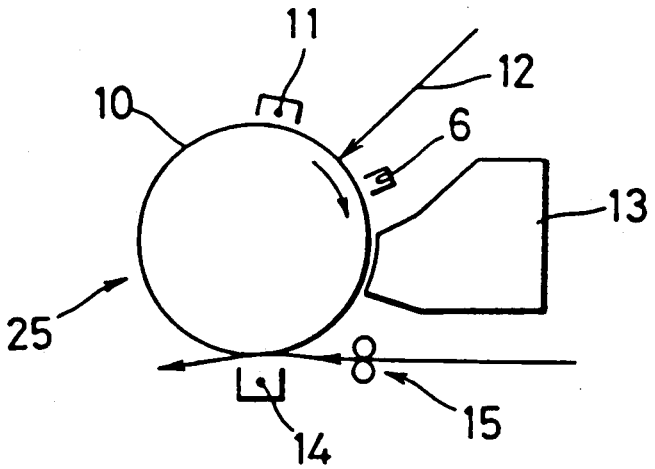
FIG. 3 is a diagram showing the structure of an image forming section.

FIG. 3 is a diagram showing the image forming section 25 of the electrophotographic copying apparatus. The photoreceptor drum 10 is provided in the image forming section 25. At the time of copying, the surface of the photoreceptor drum 10 is charged to a constant potential by a corona discharger 11. When light 12 for exposure, guided from the optical system 24 is irradiated thereon, the electrostatic charges in the irradiated portion are removed, and thereby an electrostatic latent image is formed. The electrostatic latent image is developed into a toner image by a developing device 13. However, the electrostatic charges unnecessary for developing are removed by the illumination of the blank lamp 6. A transferring corona discharger 14 copies the developer toner images on the paper conveyed by a copying paper conveying mechanism 15.

Figure 4:
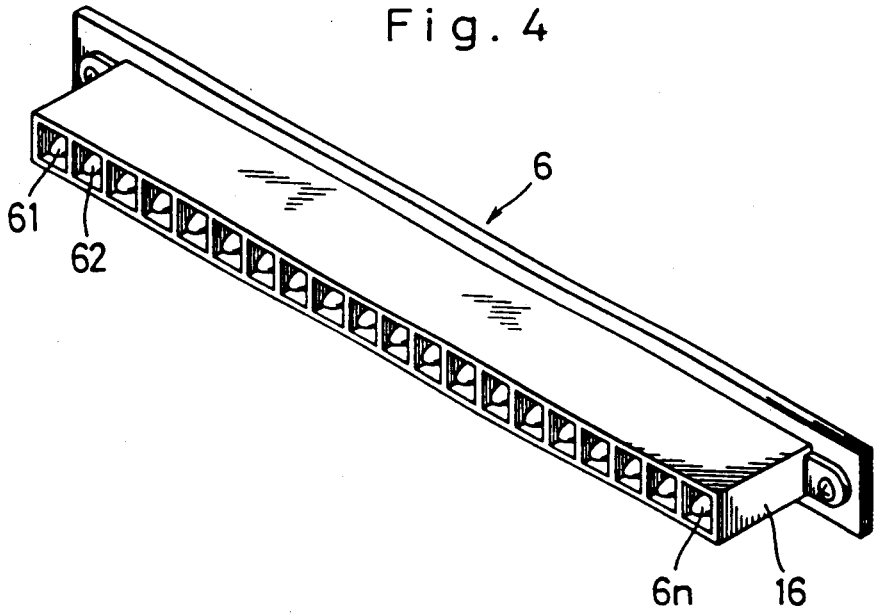
FIG. 4 is a perspective view showing the structure of a blank lamp.
Figure 5:
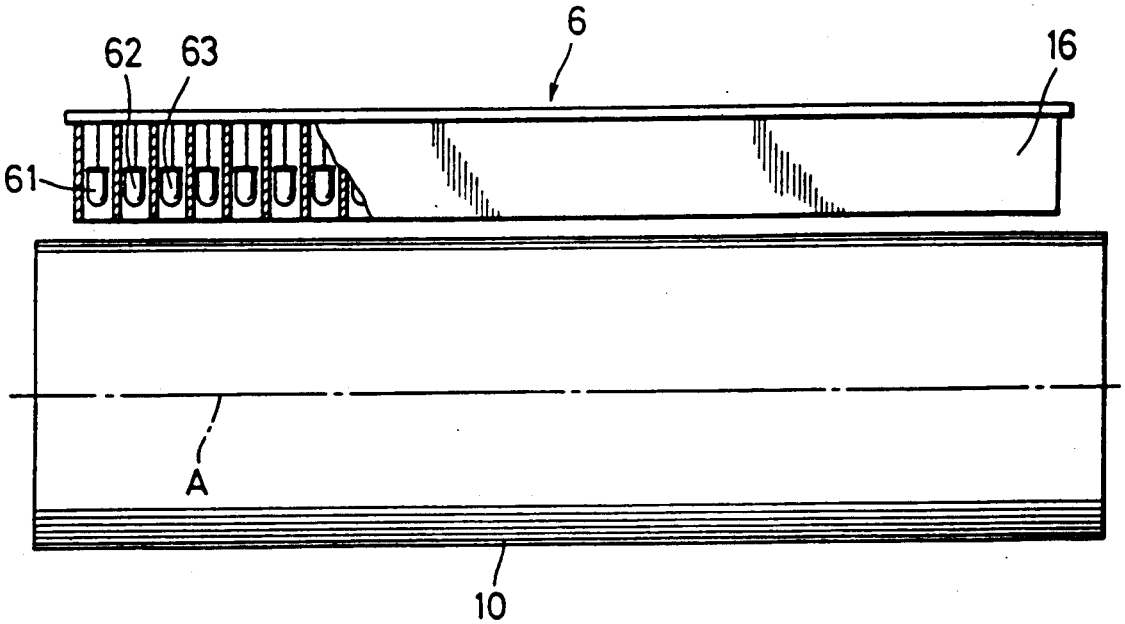
FIG. 5 is a plan view showing the relationship between the photoreceptor drum and the blank lamp.

FIG. 4 is a perspective view showing a structure of the blank lamp 6 functioning as described above. FIG. 5 is a plan view showing the positional relationship between the photoreceptor drum 10 and the blank lamp 6. As shown in FIGS. 5 and 6, the blank lamp 6 has a lot of light emitting diodes 61, 62, . . . , 6*n* aligned at a constant interval in a lamp unit 16.

Figure 1:
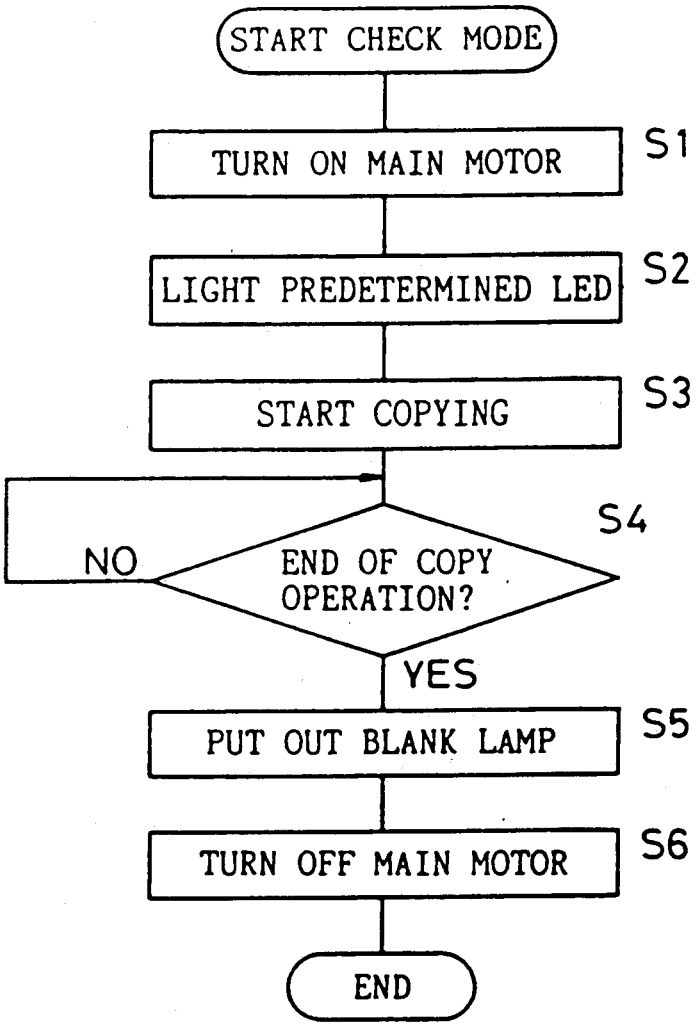
FIG. 1 is a flow chart showing the operation of check mode.

FIG. 1 is a flow chart showing the operation in the check mode. If the serviceman carries out copying in the normal mode and thereby finds distortion in copied images, he determines the cause of the distortion with the electrophotographic copying apparatus in the check mode. The check mode is set by the check mode setting key 3, as described above. Next, there will be explained the operation of the electrophotographic copying apparatus in the check mode according to the flow chart in FIG. 1.

When operation in the check mode is started, a main motor (not shown) included in the mechanical system 4 (See FIG. 2) is rotated (Step S1) and then predetermined light emitting diodes in the blank lamp 6 are lighted up (Step S2).

The serviceman initiates operation of copying with the document cover of the electrophotographic copying apparatus open or with a document in a dark color, such as black, gray or the like, set on the document setting section. If the copy starting is initiated the copy operation is started by the CPU 7 (Step S3).

At the time of copying, part of light emitting diodes 61, 62, . . . , 6*n* are selected to be lighted up. Thereby, a slender part of the surface charges on photoreceptor drum 10 can be removed in the direction of rotation thereof.

For example, if the document is entirely black, the charges in only a slender band portion are removed. Accordingly, when the document is developed by the toner images and copied on the paper, the copied images shown in FIGS. 6A and 6B are obtained.

Figure 6A:
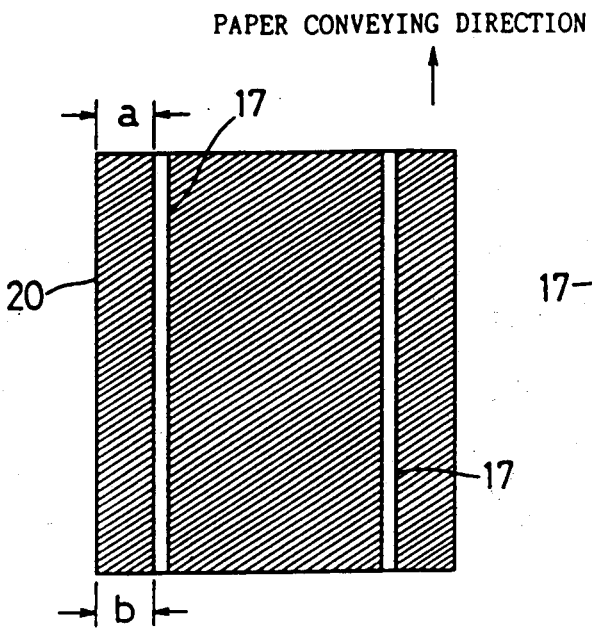
FIGS. 6A and 6B show copied images obtained by lighting only specified light emitting diodes near the two ends of the blank lamp for a predetermined time period and exposing the surface of the photoreceptor drum along the direction of rotation thereof.
Figure 6B:
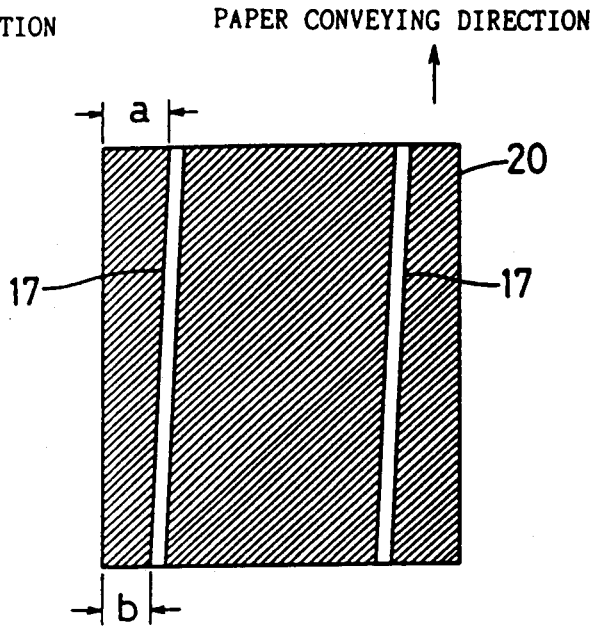

By using the copied images thus obtained, the serviceman observes whether a white band 17 formed by the blank lamp is parallel with the side of the copying paper 20 or not, i.e., whether a=b or not, as in FIG. 6A and FIG. 6B, respectively. If a=b, it can be determined that the distortion in the images is caused by the optical system. If a≠b, it can be determined that the distortion in the images is caused by the paper conveying mechanism. Thereby, the cause can be adjusted to become normal.

When the end of the copy operation is detected by CPU 7 (Step S4), the aforementioned light emitting diodes in the blank lamp 6 are put out (Step S5), then the main motor is turned OFF (Step S6), and thereafter the operation in the check mode is terminated.

Figure 7A:
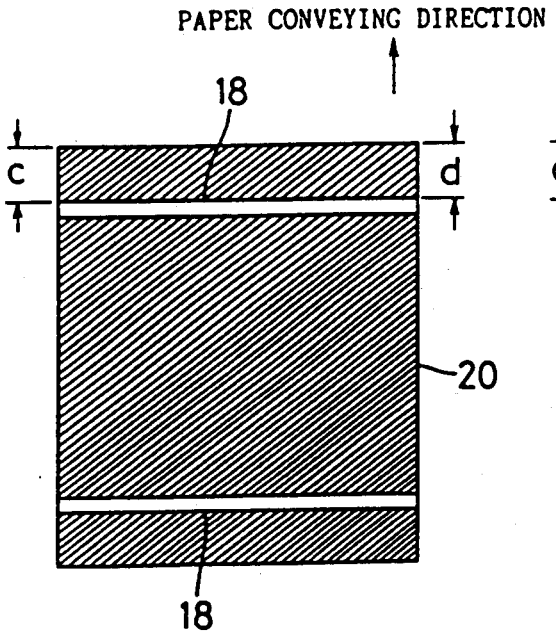
FIGS. 7A and 7B are diagrams showing one example of copied images obtained by lighting all the light emitting diodes simultaneously for a short time to remove a slender part of the surface charges on the photoreceptor drum in parallel with the axial direction thereof.
Figure 7B:
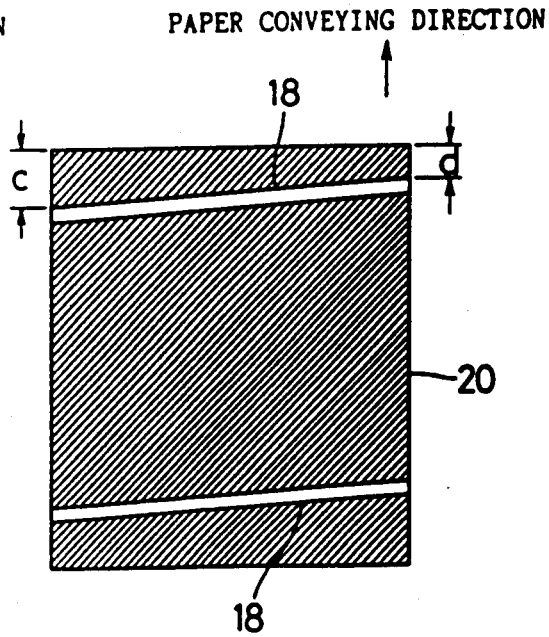
Figure 8A:
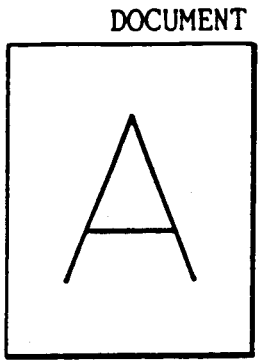
FIG. 8A represents a typical document and FIG. 8B shows the distorted copied image obtained of that document.
Figure 8B:
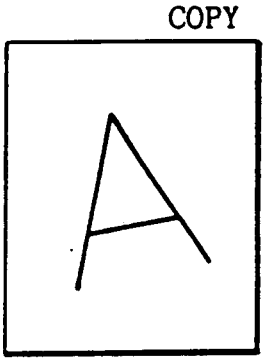
Figure 9A:
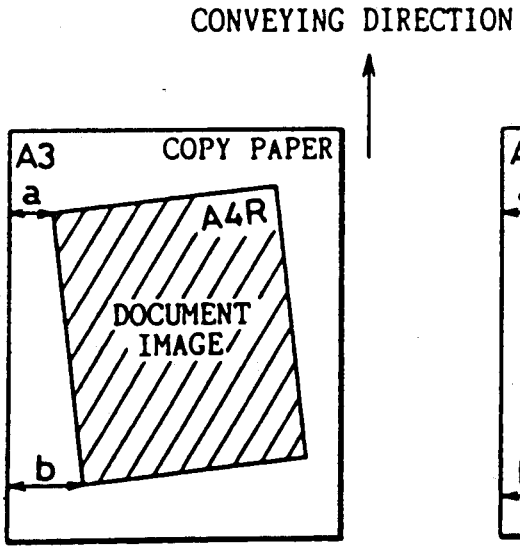
FIG. 9A shows an example of the distortion in copied images caused by a copying paper conveying mechanism in the electrophotographic copying apparatus having the reduction function.
Figure 9B:
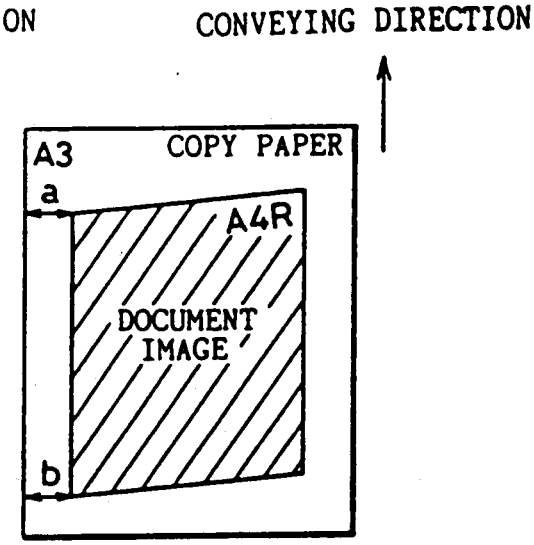
FIG. 9B shows an example of the distortion in copied images caused by an optical system in the electrophotographic copying apparatus having the reduction function.

In the control operation shown in FIG. 1, while part of light emitting diodes 61, 62, . . . , 6*n* included in the blank lamp 6 are caused to be lighted up, all the light emitting diodes 61, 62, . . . , 6*n* may be simultaneously lighted up for a short time and thereby the copied images shown in FIGS. 7A and 7B may be obtained.

Also in this case, if a white band 18 and the front or rear edge of the copying paper 20 make c=d, the distortion in the copied images is caused by the optical system, while if c≠d, it is caused by the copying paper conveying mechanism.

While the present invention has been explained on the basis of two embodiments, the present invention is not limited to the aforementioned matter.

By way of example, number of the white bands 17 or 18 obtained by lighting the blank lamp 6 is not limited to 2. One or more bands can be generated. Further, the white bands may be made intermittent by flashing the blank lamp 6.

In the above embodiments, the optical system illuminates and scans the document during the check mode. With the optical system stopped at what is called a home position, an illuminated band plate 221 (FIG. 10) in color such as black, gray or the like, in (FIG. 10), which is provided at the home position, may be illuminated, and on the basis of the images thereof, copied images for checking (black images shown in FIGS. 6A, 6B, 7A and 7B) may be obtained. Thereby, the check can be carried out without using a document or moving the optical system.

Furthermore, there can be considered the example in which the illuminated bands in a color such as black, gray or the like are not used. Namely, the photoreceptor drum is evenly charged by the corona discharger 11 without lighting light 23 in the check mode, and thereafter the band-like exposure is carried out by the blank lamp as described above, and thereby the copied images for checking may be obtained.

Moreover, the present invention is also applicable to an electrophotographic copying apparatus in which the document plate for setting the document can be moved. It should be understood that variations and modifications may be made within the scope of the invention.

What I claim is:

1. An electrophotographic copying apparatus comprising:
- a document plate;
- a photoreceptor;
- a blank lamp having a plurality of emitters for removing unnecessary electrostatic charges on said photoreceptor;
- an optical system for illuminating a document on said document plate;
- scanning means for moving one of said optical system and said document plate;
- image forming means for developing an electrostatic latent image of the document, after formation thereof on said photoreceptor by an electrophotographic method, into a toner image;
- check mode setting means adapted to be operated to check distortion in the copied images;
- copy starting means for initiating operation of said image forming means;
- blank lamp control means, responsive to a signal indicating operation of said check mode setting means and initiation of operation of said image forming means by said copying starting means, for lighting only predetermined ones of said plurality of emitters during operation of said image forming means;
- an illuminated dummy document plate disposed adjacent a home position of said optical system; and
- optical system scanning control means responsive to the signal indicating operation of said check mode setting means and initiation of operation of said image forming means by said copy starting means, for stopping the movement of said one of said optical system and said document plate during the operation of said image forming means.

2. An electrophotographic copying apparatus comprising:
- a document plate;
- a photoreceptor;
- a blank lamp having a plurality of emitters for removing unnecessary electrostatic charges on said photoreceptor;
- an optical system for illuminating a document on said document plate;
- scanning means for moving one of said optical system and said document plate;
- image forming means for developing an electrostatic latent image of the document, after formation thereof on said photoreceptor by an electrophotographic method, into a toner image;
- check mode setting means adapted to be operated to check distortion in the copied images;
- copy starting means for initiating operation of said image forming means;
- blank lamp control means, responsive to a signal indicating operation of said check mode setting means and initiation of operation of said image forming means by said copying starting means, for lighting only predetermined ones of said plurality of emitters during operation of said image forming means;
- optical system control means responsive to the signal indicating operation of said check mode setting means and initiation of operation of said image forming means by said copy starting means, for putting out said optical system to cause the photoreceptor drum to be evenly charged by the electrophotographic method.

3. An electrophotographic copying apparatus according to claim 1, wherein said blank lamp control means lights an emitter located near each end of said plurality of emitters.

4. An electrophotographic copying apparatus comprising:
- a document plate;
- a photoreceptor;
- a blank lamp having a plurality of emitters for removing unnecessary electrostatic charges on said photoreceptor;
- an optical system for illuminating a document on said document plate;
- scanning means for moving one of said optical system and said document plate;
- image forming means for developing an electrostatic latent image of the document, after formation thereof on said photoreceptor by an electrophotographic method, into a toner image;

check mode setting means adapted to be operated to check distortion in the copied images;

copy starting means for initiating operation of said image forming means;

blank lamp control means, responsive to the signal indicating operation of said check mode setting means and initiation of operation of said image forming means by said copying starting means, for lighting a series of said plurality of emitters simultaneously for a predetermined time period during operation of said image forming means;

an illuminated dummy document plate disposed adjacent a home position of said optical system; and optical system scanning control means responsive to the signal indicating operation of said check mode setting means and initiation of operation of said image forming means by said copy starting means, for stopping the movement of said one of said optical system and said document plate during the operation of said image forming means.

5. An electrophotographic copying apparatus comprising:

a document plate;

a photoreceptor;

a blank lamp having a plurality of emitters for removing unnecessary electrostatic charges on said photoreceptor;

an optical system for illuminating a document on said document plate;

scanning means for moving one of said optical system and said document plate;

image forming means for developing an electrostatic latent image of the document, after formation thereof on said photoreceptor by an electrophotographic method, into a toner image;

check mode setting means adapted to be operated to check distortion in the copied images;

copy starting means for initiating operation of said image forming means;

blank lamp control means, responsive to a signal indicating operation of said check mode setting means and initiation of operation of said image forming means by said copying starting means, for lighting a series of said plurality of emitters simultaneously for a predetermined time period during operation of said image forming means; and optical system control means, responsive to the signal indicating operation of said check mode setting means and initiation of operation of said image forming means by said copy starting means, for putting out said optical system to cause the photoreceptor drum to be evenly charged by the electrophotographic method.

6. An electrophotographic copying apparatus according to claim 4, wherein said blank lamp control means lights all of said emitters forming said blank lamp.

7. An electrophotographic copying apparatus according to claim 2, wherein said blank lamp control means lights an emitter located near each end of said plurality of emitters.

8. An electrophotographic copying apparatus according to claim 5, wherein said blank lamp control means lights all of said emitters forming said blank lamp.

* * * * *